US008924203B2

(12) United States Patent
Kim

(10) Patent No.: US 8,924,203 B2
(45) Date of Patent: Dec. 30, 2014

(54) APPARATUS AND METHOD FOR CODING SIGNAL IN A COMMUNICATION SYSTEM

(71) Applicant: Electronics and Telecommunications Research Institute, Daejeon (KR)

(72) Inventor: Hyun-Woo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 246 days.

(21) Appl. No.: 13/661,945

(22) Filed: Oct. 26, 2012

(65) Prior Publication Data

US 2013/0117028 A1 May 9, 2013

(30) Foreign Application Priority Data

Oct. 28, 2011 (KR) ..... 10-2011-0111464
Oct. 26, 2012 (KR) ..... 10-2012-0119933

(51) Int. Cl.

*G10L 19/12* (2013.01)
*G10L 19/04* (2013.01)
*G10L 19/038* (2013.01)
*G10L 19/24* (2013.01)

(52) U.S. Cl.

CPC ..... *G10L 19/04* (2013.01); *G10L 19/038* (2013.01); *G10L 19/12* (2013.01); *G10L 19/24* (2013.01)
USPC ..... 704/223

(58) Field of Classification Search

USPC ..... 704/219–230
See application file for complete search history.

(56) References Cited

U.S. PATENT DOCUMENTS

| | | | | |
|---|---|---|---|---|
| 6,475,245 | B2 * | 11/2002 | Gersho et al. | 704/208 |
| 7,106,228 | B2 | 9/2006 | Bessette et al. | |
| 8,271,274 | B2 * | 9/2012 | Massaloux et al. | 704/219 |
| 2009/0024395 | A1 | 1/2009 | Banba | |
| 2009/0234644 | A1 | 9/2009 | Reznik et al. | |
| 2009/0240491 | A1 | 9/2009 | Reznik | |

FOREIGN PATENT DOCUMENTS

| | | | |
|---|---|---|---|
| EP | 1113418 | B1 | 7/2001 |
| EP | 2101319 | A1 | 9/2009 |
| JP | 11-305798 | | 11/1999 |
| JP | 2005-202262 | | 7/2005 |
| KR | 1020100086031 | | 7/2010 |

OTHER PUBLICATIONS

Ragot, Stephane et al., "ITU-T G.729.1: An 8-32 KBIT/S Scalable Coder Interoperable with G.729 for Wideband Telephony and Voice Over IP," ICASSP, pp. IV-529-IV-532 (2007).

* cited by examiner

*Primary Examiner* — Abul Azad
(74) *Attorney, Agent, or Firm* — Nelson Mullins Riley & Scarborough LLP

(57) ABSTRACT

Disclosed are an apparatus for coding a signal in a communication system including: a coding unit configured to code voice and audio signals based on a code excited linear prediction (CELP) coding method; a residual signal calculation unit configured to calculate residual signals of the voice and audio signals; a frequency transform unit configured to transform the residual signal into a signal in a frequency domain; an energy calculation unit configured to use frequency coefficients of the residual signals to calculate frequency energy of the residual signals; an energy concentration calculation unit configured to calculate energy concentrations of each vector dimension of the residual signals from the frequency energy of the residual signals; and a vector dimension determination unit configured to compare the energy concentrations of each vector dimension to determine targeted vector dimensions of the residual signals.

20 Claims, 2 Drawing Sheets

APPARATUS AND METHOD FOR CODING SIGNAL IN A COMMUNICATION SYSTEM

CROSS-REFERENCES TO RELATED APPLICATIONS

The present application claims priority of Korean Patent Application Nos. 10-2011-0111464 and 10-2012-0119933, filed on Oct. 28, 2011, and Oct. 26, 2012, respectively, which are incorporated herein by reference in their entirety.

BACKGROUND OF THE INVENTION

1. Field of the Invention

Exemplary embodiments of the present invention relate to a communication system, and more particularly, to an apparatus and a method for coding voice and audio signals using a code excited linear prediction (hereinafter, referred to as 'CELP') coding method in a communication system.

2. Description of Related Art

In a communication system, researches for providing services having various qualities of services (hereinafter, referred to as QoSs) to users at a high transmission rate have been actively conducted. The communication system has proposed methods for transmitting data having various types of QoSs at high speed through a limited resource. Recently, as a method for compressing and transmitting voice and audio signals in a network so as to cope with development of a network and the increase in a user demand, methods for compressing and reconstructing a pulse code modulation (hereinafter, referred to as 'PCM') signal have been proposed. Many voice/audio codecs for compressing and reconstructing the PCM signal have been developed.

Meanwhile, as an example of the voice/audio codec, recent codecs such as ITU-T, G729.1, G.718, and the like support multi bit rates using an embedded structure and implement a high compression rate based on the CELP technology that models a process of generating voice and audio signals in a low bit rate of the multi bit rates. In addition, residual signals of the voice and audio signals in a high bit rate of the multi bit rates are quantized by transforming a time domain into a frequency domain based on a modified discrete cosine transform (hereinafter, referred to as 'MDCT') or a discrete Fourier transform (hereinafter, referred to as 'DFT').

Here, the CELP technology is a technology designed to be more suitable for voice rather than for music in the voice and audio signals and makes characteristics of the residual signals that are a difference between an original sound and a synchronized signal coded by the CELP technology different. That is, in the case of voice, the CELP technology properly represents a formant having a large frequency size and a pitch, but in the case of music, does not properly represent a formant and a pitch, such that a larger frequency component remains in the residual signals. That is, in the CELP technology, even in the case of the same voice, in the signal having the uniformly distributed frequency due to the accurately represented formant and pitch as well as the signal due to the inaccurately represented formant and pitch as described above, the coefficient having a large frequency may appear in the residual signals.

However, in the current communication system, when the voice and audio signals are coded by the CELP technology, that is, the CELP coding method, as described above, a detailed method for normally processing the residual signals of the voice and audio signals has not yet been proposed. In particular, the residual signals are not normally processed to degrade the coding performance of the voice and audio signals based on the CELP coding method, such that the high quality of services may be provided to users.

Therefore, a need exists for a method for coding voice and audio signals based on a CELP coding method so as to provide a high quality of voice and audio services in a communication system.

SUMMARY OF THE INVENTION

An embodiment of the present invention is directed to an apparatus and a method for coding a signal in a communication system.

Another embodiment of the present invention is directed to an apparatus and a method for coding voice and audio signals using a code excited linear prediction (CELP) coding method in a communication system.

Still another embodiment of the present invention is directed to an apparatus and a method for coding a signal capable of normally processing residual signals by determining a quantization vector dimension according to a distribution of frequency coefficients of the residual signals of voice and audio signals at the time of coding the voice and audio signals using a CELP coding method in a communication system.

Still yet another embodiment of the present invention is directed to an apparatus and a method for coding a signal capable of improving a quality of voice and audio services by normally processing residual signals by determining a quantization vector dimension according to energy concentration based on analysis of frequency characteristics of the residual signals of voice and audio signals, at the time of coding the voice and audio signals using a CELP coding method in a communication system.

An apparatus for coding a signal in a communication system includes: a coding unit configured to code voice and audio signals based on a code excited linear prediction (CELP) coding method; a residual signal calculation unit configured to calculate residual signals of the voice and audio signals; a frequency transform unit configured to transform the residual signal into a signal in a frequency domain; an energy calculation unit configured to use frequency coefficients of the residual signals to calculate frequency energy of the residual signals; an energy concentration calculation unit configured to calculate energy concentrations of each vector dimension of the residual signals from the frequency energy of the residual signals; and a vector dimension determination unit configured to compare the energy concentrations of each vector dimension to determine targeted vector dimensions of the residual signals.

A method for coding a signal in a communication system includes: coding voice and audio signals based on a code excited linear prediction (CELP) coding method; calculating residual signals of the voice and audio signals; transforming the residual signal into a signal in a frequency domain; using frequency coefficients of the residual signals to calculate frequency energy of the residual signals; calculating energy concentrations of each vector dimension of the residual signals from the frequency energy of the residual signals; and comparing the energy concentrations of each vector dimension to determine targeted vector dimensions of the residual signals.

DESCRIPTION OF SPECIFIC EMBODIMENTS

Figure 1:
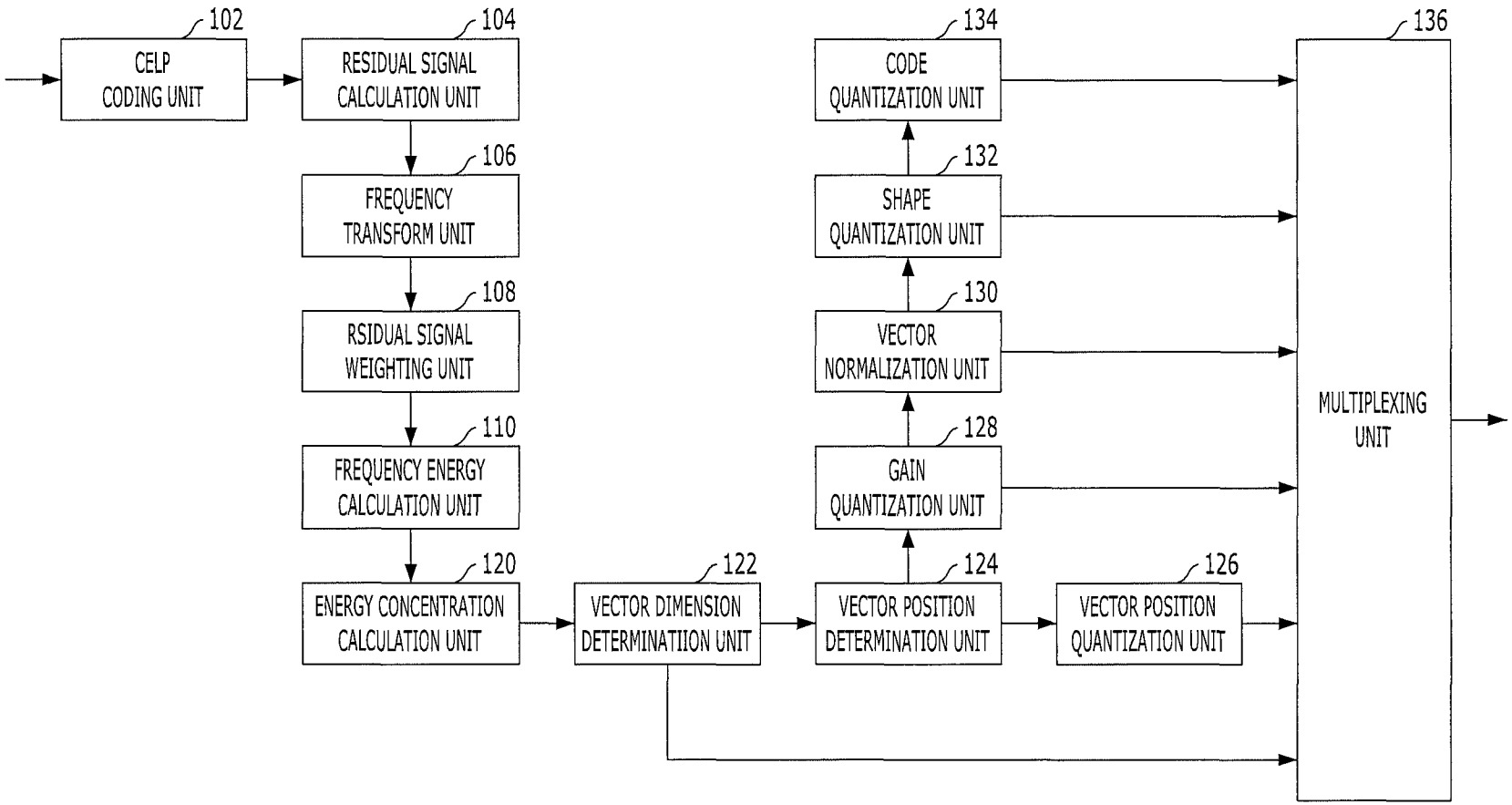
FIG. 1 is a diagram schematically illustrating a structure of an apparatus for coding a signal in a communication system in accordance with an embodiment of the present invention.

Hereinafter, exemplary embodiments of the present invention will be described in detail with reference to the accompanying drawings. It is to be noted that only components required to understand an operation in accordance with the present invention is described below and the description of other components will be omitted not to unnecessarily obscure the subject matters of the present invention.

The present invention propose an apparatus and a method for coding a signal in a communication system. Herein, the embodiment of the present invention describes, by way of example, an apparatus and a method for coding voice and audio signals for providing services having various qualities of services (hereinafter, referred to as 'QoS'), for example, voice and audio services in a communication system, but a method for coding a signal proposed by the embodiment of the present invention may be similarly applied to the case of coding signals corresponding to other services.

Further, the embodiment of the present invention proposes an apparatus and a method for coding voice and audio signals in a communication system using a code excited linear prediction (hereinafter, referred to as 'CELP') coding method. Here, at the time of coding the voice and audio signals using the CELP coding method in the communication system, a quantization vector dimension is determined according to a distribution of frequency coefficients of the residual signals of voice and audio signals to normally process the residual signals, thereby improving the coding performance of the voice and audio signals. Further, in the embodiment of the present invention, as described above, at the time of coding the voice and audio signals using the CELP coding method, the quantization vector difference is determined according to the energy concentration based on analysis of the frequency characteristics of the residual signals of the voice and audio signals, such that the residual signals of the voice and audio signals are normally processed, thereby providing the high-quality of voice and audio services.

Here, in the communication system in accordance with the embodiment of the present invention, at the time of coding the voice and audio signals based on the CELP coding method, the frequency characteristics of the residual signal of the voice signal is uniformly distributed, but peak component of the residual signal of a music signal, that is, the audio signal strongly appears, such that the quantization vector dimension is determined in consideration of the frequency characteristic distribution of the residual signals of the voice and audio signals to perform efficient quantization with a limited bit, thereby normally processing the residual signals. That is, in the embodiment of the present invention, when the CELP coding method is applied to the voice and audio signals and the residual signals of the voice and audio signals are coded, the targeted vector dimension is determined according the distribution of frequency coefficients of the residual signals to normally process the residual signals, thereby providing the high quality of voice audio services.

Further, in the embodiment of the present invention, a targeted vector dimension to be coded is controlled by analyzing a spectral distribution of the residual signals of the voice and audio signals structurally generated according to the CELP coding method in a voice/audio codec using a multi bit rate, such that the residual signals of the voice and audio signals are normally processed, thereby providing the high quality of voice and audio services. In this case, in accordance with the embodiment of the present invention, in the spectral distribution of the residual signal, when the residual signal has several specific large frequencies, the targeted vector dimension to be coded is reduced and thus the large frequency of the residual signal is more delicately quantized with a limited bit to more normally process the residual signal, thereby improving the quality of voice and audio services. Further, in the spectral distribution of the residual signal, when the frequency of the residual signal is uniformly distributed, the targeted vector dimension to be coded is increased to perform quantization.

That is, in the embodiment of the present invention, the targeted vector dimension is determined by analyzing the frequency distribution of the residual signal of the voice and audio signals to reduce the quantization error, thereby improving the sound quality of the voice/audio codec. In the embodiment of the present invention, the frequency distribution of the residual signal is analyzed by calculating the energy concentrations of the residual signals. In this case, the dimension is determined in a manner that when the energy concentration is increased, the targeted vector dimension is small, when the energy concentration is reduced, the targeted vector dimension is large, such that the more important frequency coefficient is delicately quantized, thereby improving the quality of voice and audio services.

That is, in the existing voice/audio codec, when the targeted vector dimensions of the residual signals are fixed to be the same as the number of frequency coefficients and thus includes several large frequencies, that is, a frequency having strong tone component like the residual signal of the music signal, that is, the audio signal, the quantization of large frequency coefficients is not delicately performed, such that the degradation in the voice and audio service quality occurs at the time of coding the existing voice and audio signals, but as described above, in the embodiment of the present invention, at the time of coding the voice and audio signals using the CELP coding method, the targeted vector dimension is controlled and determined according to the frequency distribution of the residual signals of the voice and audio signals to delicately quantize the voice and audio services, in particular, the audio signal such as a music signal, and the like, thereby providing the high quality of voice and audio services. Herein, an apparatus for coding voice and audio signals in the communication system in accordance with the embodiment of the present invention will be described in detail with reference to FIG. 1.

FIG. 1 is a diagram schematically illustrating a structure of an apparatus for coding a signal in a communication system in accordance with an embodiment of the present invention.

Referring to FIG. 1, the apparatus for coding a signal includes a CELP coding unit 102 configured to code voice and audio signals based on a CELP coding method, a residual signal calculation unit 104 configured to calculate residual signals of the voice and audio signals, a frequency transform unit 106 configured to transform the residual signal into a signal in a frequency domain, a residual signal weighting unit 108 configured to acquire a weighting signal from frequency coefficients of the residual signal, a frequency energy calculation unit 110 configured to calculate frequency energy using frequency coefficients of the residual signals, an energy concentration calculation unit 120 configured to calculate energy concentrations of each vector dimension of the frequency energy, and a vector dimension determination unit 122 configured to determine vector dimensions by comparing the energy concentration. As described above, the apparatus for coding a signal in the communication system in accordance with the embodiment of the present invention analyzes a signal frequency distribution based a CELP codec using the CELP coding unit 102, the residual signal calculation unit 104, the frequency transform unit 106, the residual signal weighting unit 108, the frequency energy calculation unit 110, and the energy concentration calculation unit 120 and determines the targeted vector dimension using the vector dimension determination unit 122.

Further, the apparatus for coding a signal includes a vector position determination unit 124 configured to determine a position of a targeted vector as much as a targeted vector dimension, a vector position quantization unit 126 configured to quantize a position of frequency coefficients allocated as the targeted vector, a gain quantization unit 128 configured to quantize a gain of the targeted vector, a vector normalization unit 130 configured to normalize the targeted vector with a quantized gain, a shape quantization unit 132 configured to shape-quantize a normalized targeted vector, a code quantization unit 134 configured to quantize a position of a code of shape-quantized vector, and a multiplexing unit 136 configured to multiplex the quantized parameters of the quantization units 126, 128, 132, and 134 and the determined targeted vector dimension.

Describing in more detail, the CELP coding unit 102 receives voice and audio signals as a pulse code modulation (hereinafter, referred to as 'PCM') signal and codes the voice and audio signals using the CELP codec. As an example of the foregoing voice/audio codec, in a G.729.1 codec, the voice and audio signals are down-sampled at 8 kHz and then, coded by the CLEP codec and in a G.718 codec, the voice and audio signals are down-sampled at 12.8 kHz and are coded by the CELP codec.

The residual signal calculation unit 104 calculates a difference between the voice and audio signals of the PCM signal, that is, the original voice and audio signals and a resynchronized signal by the CELP codec of the CLEP coding unit 102, that is, calculates the residual signals of the voice and audio signals. For example, in the G.718 codec, the voice and audio signals are coded by the CELP codec and then the difference between the voice and audio signals up-sampled at 16 kHz and the original voice and audio signals is calculated, thereby generating the residual signals.

The frequency transform unit 106 transforms the residual signal from a time domain into a frequency domain, that is, transforms the residual signal from a time domain into a frequency domain by a modified discrete cosine transform (hereinafter, referred to as 'MDCT') or a discrete Fourier transform (hereinafter, referred to as 'DFT').

As described above, the residual signal weighting unit 108 receives frequency coefficients of the residual signals transformed into the frequency domain and applies a perceptual weighting filter to the frequency coefficients of the residual signal to acquire the weighting signal of the residual signals. In this configuration, the residual signal weighting unit 108 applies the perceptual weighting filter by a manner emphasizing formant in the foregoing CELP technology or applies a masking effect in a moving picture experts group (MPEG) technology to acquire weighting signals of the residual signals from the frequency coefficients of the residual signals.

The frequency energy calculation unit 110 uses the frequency coefficients of the residual signals to calculate frequency energy of the residual signals. Here, the frequency energy calculation unit 110 uses coefficients through the perceptual weighting filter as it is when the frequency coefficient of the residual signal is the MDCT coefficient to calculate the frequency energy of the residual signal and calculates a sum of a square of real component and image component of the DFT coefficient when the frequency coefficient of the residual signal is a DFT coefficient and then applies the perceptual weighting filter to calculate the frequency energy of the residual signal. Further, the frequency energy calculation unit 110 groups a frequency of the residual signal into any sub-bands so as to reduce calculations at the time of the calculation of the frequency energy calculation of the residual signal, thereby calculating the sub-band of the residual signal with the frequency energy of the residual signal.

For example, when a total of 320 MDCT coefficients are present as the frequency coefficients of the residual signal, the frequency energy calculation unit 110 uses a total of 320 MDCT coefficients to calculate the 320 frequency energies of the residual signal or groups four MDCT coefficients into one sub band to calculate the sub band of the four MDCT coefficients and calculate the sub-band energy of the four MDCT coefficients, that is, 80 sub-band energies and the sub-band energy may be represented by the following Equation 1.

$$e(n) = \sum_{i=1}^{4} x^2(4n+i),\ n = 0, \ldots, 79 \qquad \text{[Equation 1]}$$

In the above Equation 1, e(n) means the sub-band energy of the four MDCT coefficients and n means the sub-band index.

The energy concentration calculation unit 120 receives each frequency energy of the residual signals and calculates the energy concentrations of each vector dimension of the residual signals from each frequency energy of the residual signals. For example, as described above, when the frequency energy of the residual signal calculated by the frequency energy calculation unit 110 is 320 and the targeted vector dimension is 16, 32, and 48, the energy concentration calculation unit 120 arranges the 320 frequency energies in a sequence of an energy size so as to calculate the energy concentrations of each vector dimension.

Further, the energy concentration calculation unit 120 sums the arranged 320 frequency energies in a sequence of an energy size, that is, 16 frequency energies, 32 frequency energies, 48 frequency energies, and 320 frequency energies, respectively and then calculates a total of 16 summed frequency energies (ener 16), a total of 32 summed frequency energies ener32, a total of 48 summed frequency energies (ener 48), and a total of 320 summed frequency energies (ener 320), respectively. Further, the energy concentration calculation unit 120 uses the total of summed frequency energies to calculate the energy concentrations of each vector dimension, that is, energy concentrations of 16 vector dimensions (EC16=ener16/ener30), energy concentration (EC32=ener32/ener 320) of vector dimensions, and energy concentrations of 48 vector dimensions (EC48=ener48/ener320), respectively.

The vector dimension determination unit 122 compares the energy concentrations of each vector dimension calculated by the energy concentration calculation 120 to determine the targeted vector dimension. Here, the vector dimension determination unit 122 determines as the targeted vector dimension the vector dimension having a maximum value in the energy concentrations of each vector dimension calculated by the energy concentration calculation 120. For example, in the energy concentration (EC16) of 16 vector dimensions, the energy concentrations of 32 vector dimensions (EC32), and the energy concentration (EC48) of 48 vector dimensions, that is, EC16, $\gamma 1 \times$EC32, and $\gamma 2 \times$EC48, when a maximum value is EC16, the 16 vector dimensions are determined as the targeted vector dimension, when a maximum value is larger than γ1×EC32, the 32 vector dimensions are determined as the targeted vector dimension, when the maximum value is larger than γ2×EC48, the 48 vector dimensions are determined as the targeted vector dimension, and when the maximum value is smaller than β, the 320 vector dimensions are determined as the targeted vector dimension. Here, the γ1 and γ2 mean any setting values having 0.8 to 1.2 and the β means any setting values having 0.5 to 0.8.

The vector position determination unit 124 allocates an absolute value of frequency coefficients to the targeted vector in a large sequence as much as the targeted vector dimension determined by the vector dimension determination unit 122 and stores the position of the targeted vector to which the frequency coefficients are allocated, that is, determines the position of the targeted vector.

The vector position quantization unit 126 calculates the position of the targeted vector to which the frequency coefficients are allocated and quantizes the position of the targeted vector. For example, when the 16 vector dimensions are the targeted vector dimension and the 16 frequency coefficients are allocated to the targeted vector, the vector position quantization unit 126 calculates the position of the frequency coefficients allocated to the targeted vector, that is, a position pi of the targeted vector to which the frequency coefficients are allocated and then quantizes the position pi of the targeted vector to which the frequency coefficients are allocated and the position quantization of the targeted vector may be represented by a binary bit as in the following Equation 2.

$$\sum_{i=1}^{16} \frac{p(i)!}{i!(p(i)-i)!} \quad \text{[Equation 2]}$$

The gain quantization unit 120 quantizes a gain $$\text{Gain} = \left(\sum_{i=1}^{16} x^2(p(i))\right)^{1/2}$$

of the targeted vector. Here, the gain quantization unit 128 uses a training data to quantize the gain of the targeted vector with a value most approximating a previously generated codebook.

The vector normalization unit 130 normalizes the targeted vector with the gain of the targeted vector quantized by the gain quantization unit 128.

The shape quantization unit 132 quantizes the targeted vector normalized by the vector normalization unit 130. Here, the shape quantization unit 132 performs the quantization by applying Algebraic vector quantization to the normalized targeted vector or as described above, uses the training data to quantize the normalized targeted vector with the value most approaching the previously generated codebook.

The code quantization unit 134 quantizes the position code of the targeted vector quantized by the shape quantization unit 132. That is, the code quantization unit 134 quantizes the position code of the quantized targeted vector.

As described above, the multiplexing unit 136 multiplexes the quantized targeted vector, the normalized targeted vector, the position and gain of the quantized targeted vector, and the vector dimension of the targeted vector. Herein, the apparatus for coding a signal in the communication system in accordance with the embodiment of the present invention will be described in detail with reference to FIG. 2.

Figure 2:
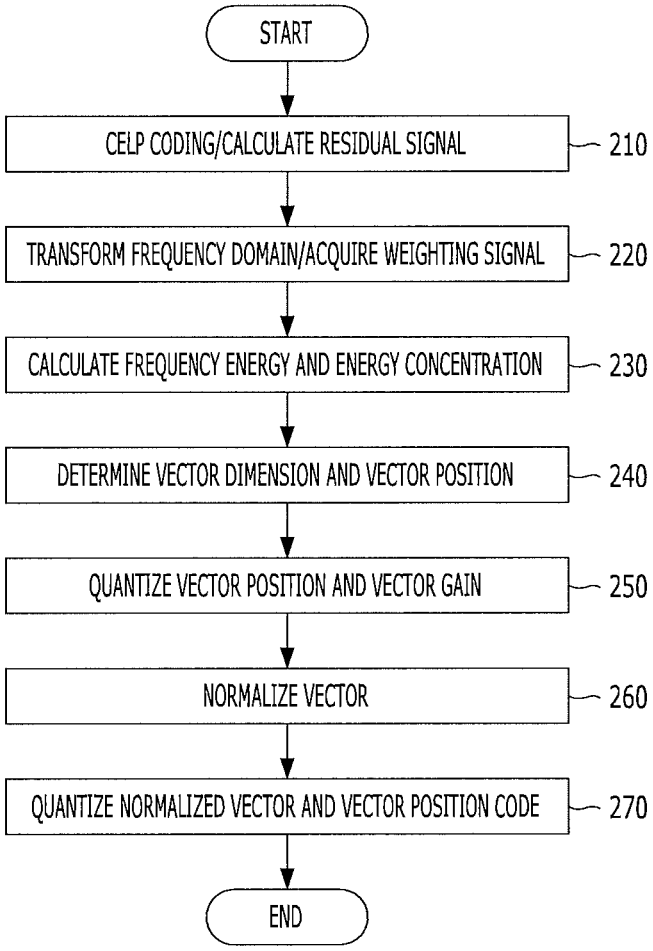
FIG. 2 is a diagram schematically illustrating a coding process of the apparatus for coding a signal in the communication system in accordance with the embodiment of the present invention.

FIG. 2 is a diagram schematically illustrating a coding process of the apparatus for coding a signal in the communication system in accordance with the embodiment of the present invention.

Referring to FIG. 2, in S210, the apparatus for coding a signal receives the voice and audio signals as the PCM signal, codes the voice and audio signals using the CLEP codec, and calculates the difference between the voice and audio signals of the PCM signal, that is, the original voice and audio signals and the signal re-synthesized by the CELP codec, that is, the residual signals of the voice and audio signals.

In S220, the residual signals are transformed from a time domain to a frequency domain, that is, transformed into a frequency domain based on the DFT and the perceptual weighting filter is applied to the frequency coefficients of the residual signals, thereby acquiring the weighting signal of the residual signal.

Next, in S230, the frequency energy of the residual signal is calculated using the frequency coefficients of the residual signal and then the energy concentrations of each vector dimension of the residual signals is calculated from each frequency energy of the residual signals.

Next, in S240, the targeted vector dimension is determined by comparing between the energy concentrations between the respective calculated vector dimensions, the frequency coefficients are allocated to the targeted vector in an order that the absolute value of the frequency coefficients are large and the position of the targeted vector to which the frequency coefficients are allocated, that is, the position of the targeted vector is determined.

In S250, the position of the targeted vector is quantized by calculating the position of the targeted vector to which the frequency coefficients are allocated to quantize the position of the targeted vector and quantize the gain of the targeted vector.

Next, in S260, the targeted vector is normalized with the gain of the quantized targeted vector and then, in S270, the normalized targeted vector is quantized and the position code of the quantized targeted vector is quantized.

In the communication system in accordance with the embodiment of the present invention, in the voice/audio codec using the multi bit rate, the frequency distribution of the residual signal is analyzed based on the spectral distribution of the residual signals of the voice and audio signals structurally generated according the CELP coding method, that is, the energy concentrations of the residual signals, and the like. In this case, in the frequency distribution of the residual signals, when the residual signal has several specific large frequencies, the targeted vector dimension to be coded is reduced to quantize the targeted vector dimension to be coed to more delicately quantize the large frequency of the residual signal with a limited bit and more normally process the residual signals, thereby improving the quality of voice and audio services and increase the targeted vector dimension to be decoded when the frequency of the residual signal is uniformly distributed in the frequency distribution of the residual signal, thereby performing the quantization. In the communication system in accordance with the embodiment of the present invention, as described above, the frequency distribution of the residual signal is analyzed by calculating the energy concentrations of the residual signals. In this case, the dimension is determined in a manner that when the energy concentration is increased, the targeted vector dimension is small, when the energy concentration is reduced, the targeted vector dimension is large, such that the more important frequency coefficient is delicately quantized, thereby improving the quality of voice and audio services.

The present invention determines the quantization vector dimension according to the distribution of the frequency coefficients of the residual signals of the voice and audio signals at the time of coding the voice and audio signals using the CELP coding method in the communication system, in particular, determines the quantization vector dimension according to the energy concentration based on the analysis of the frequency characteristics of the residual signals to normally process the residual signal of the voice and audio signals, such that the coding performance of the voice and audio signals using the CELP coding method may be increased, thereby providing the high quality of voice and audio services.

Meanwhile, the embodiments is described in detail in the detailed description of the present invention, but may be variously modified without departing from the scope of the present invention. Accordingly, the scope of the present invention is not construed as being limited to the described embodiments but is defined by the appended claims as well as equivalents thereto.

What is claimed is:

1. An apparatus for coding a signal in a communication system, comprising:

a coding unit configured to code voice and audio signals based on a code excited linear prediction (CELP) coding method;

a residual signal calculation unit configured to calculate residual signals of the voice and audio signals;

a frequency transform unit configured to transform the residual signal into a signal in a frequency domain;

an energy calculation unit configured to use frequency coefficients of the residual signals to calculate frequency energy of the residual signals;

an energy concentration calculation unit configured to calculate energy concentrations of each vector dimension of the residual signals from the frequency energy of the residual signals; and a vector dimension determination unit configured to compare the energy concentrations of each vector dimension to determine targeted vector dimensions of the residual signals.

2. The apparatus of claim 1, wherein the vector dimension determination unit determines the vector dimensions having a maximum value as the targeted vector dimensions in the energy concentrations of each vector dimension.

3. The apparatus of claim 1, wherein the residual signal calculation unit calculates a difference between the voice and audio signals and a signal synthesized by a CELP codec by a CELP coding method.

4. The apparatus of claim 1, wherein the frequency transform unit transforms the residual signals from a domain time into a frequency domain by a modified discrete cosine transform (MDCT) or a discrete Fourier transform (DFT).

5. The apparatus of claim 1, wherein a residual signal weighting unit configured to apply a perceptual weighting filter to frequency coefficients of the residual signals to acquire weighting signals of the residual signals.

6. The apparatus of claim 1, wherein the energy calculation unit uses the frequency coefficients of the residual signals to calculate energy in a sub-band of the residual signals.

7. The apparatus of claim 1, wherein the energy concentration calculation unit arranges the frequency energies of the residual signals in an energy size sequence and calculates the frequency energies of each vector dimension according to the size sequence to calculate the energy concentrations of each vector dimension.

8. The apparatus of claim 1, further comprising:

a position determination unit configured to allocate the frequency coefficients to the targeted vectors of the residual signals as much as the targeted vector dimension in a sequence that absolute values of the frequency coefficients are large to store the position of the targeted vector to which the frequency coefficients are allocated; and a quantization unit configured to calculate the position of the frequency coefficients allocated to the targeted vector to quantize the position of the targeted vector.

9. The apparatus of claim 8, further comprising:

a gain quantization unit configured to quantize a gain of the targeted vector;

a normalization unit configured to normalize the targeted vector with the gain of the quantized targeted vector;

a shape quantization unit configured to quantize the normalized targeted vector; and a code quantization unit configured to quantize a position code of the targeted vector.

10. The apparatus of claim 9, wherein the gain quantization unit uses a training data to quantize the gain of the targeted vector with a value most approximating a previously generated codebook, and the shape quantization unit performs quantization by applying Algebraic vector quantization to the normalized targeted vector or quantizes the normalized targeted vector with the value most approaching the codebook.

11. A method for coding a signal in a communication system, comprising:

coding voice and audio signals based on a code excited linear prediction (CELP) coding method;

calculating residual signals of the voice and audio signals;

transforming the residual signal into a signal in a frequency domain;

using frequency coefficients of the residual signals to calculate frequency energy of the residual signals;

calculating energy concentrations of each vector dimension of the residual signals from the frequency energy of the residual signals; and comparing the energy concentrations of each vector dimension to determine targeted vector dimensions of the residual signals.

12. The method of claim 11, wherein in the determining of the targeted vector dimension, the vector dimensions having a maximum value is determined as the targeted vector dimensions in the energy concentrations of each vector dimension.

13. The method of claim 11, wherein in the calculating of the residual signal, a difference between the voice and audio signals and a signal synthesized by a CELP codec is calculated by a CELP coding method.

14. The method of claim 11, wherein in the transforming into the frequency domain, the residual signals is transformed from a domain time into a frequency domain by a modified discrete cosine transform (MDCT) or a discrete Fourier transform (DFT).

15. The method of claim 11, further comprising:

applying a perceptual weighting filter to frequency coefficients of the residual signals to acquire weighting signals of the residual signals.

16. The method of claim 11, wherein in the calculating of the frequency energy, energy in a sub-band of the residual signals is calculated using the frequency coefficients of the residual signals.

17. The method of claim 11, wherein in the calculating of the energy concentrations, the frequency energies of the residual signals are arranged in an energy size sequence and then the frequency energy of each vector dimension is each calculated according to the size sequence to calculate the energy concentrations of each vector dimension.

18. The method of claim 11, further comprising:

allocating the frequency coefficients to the targeted vectors of the residual signals as much as the targeted vector dimension in a sequence that absolute values of the frequency coefficients are large to store the position of the targeted vector to which the frequency coefficients are allocated; and calculating the position of the frequency coefficients allocated to the targeted vector to quantize the position of the targeted vector.

19. The method of claim 18, further comprising:

quantizing a gain of the targeted vector;

normalizing the targeted vector with the gain of the quantized targeted vector;

quantizing the normalized targeted vector; and quantizing a position code of the targeted vector.

20. The method of claim 19, wherein in the quantizing of the gain, the gain of the targeted vector is quantized with a value most approximating a previously generated codebook using a training data, and in the shape quantizing, Algebraic vector quantization is applied to the normalized targeted vector to perform quantization or the normalized targeted vector is quantized with the value most approaching the codebook.

* * * * *